United States Patent [19]

Jones

[11] Patent Number: 4,745,286

[45] Date of Patent: May 17, 1988

[54] LUMINOUS SHEET AND INDICIA

[76] Inventor: Billy R. Jones, 731 W. Wadley, Bldg. O, Suite 100, Midland, Tex. 79705

[21] Appl. No.: 871,689

[22] Filed: Jun. 9, 1986

[51] Int. Cl.[4] ..... F21K 2/00

[52] U.S. Cl. ..... 250/459.1; 250/462.1; 40/542

[58] Field of Search ..... 250/483.1, 462.1, 482.1, 250/458.1, 459.1; 40/542; 378/185; 428/904.4

[56] References Cited

U.S. PATENT DOCUMENTS

| | | | |
|---|---|---|---|
| 1,543,931 | 6/1925 | Law | 250/462.1 |
| 2,382,806 | 8/1945 | Motson | 40/542 |
| 2,460,221 | 1/1949 | Gordon | 250/483.1 |
| 2,887,379 | 5/1959 | Blake et al. | 430/139 |
| 3,107,138 | 10/1963 | Massena | 430/139 |
| 3,879,611 | 4/1975 | Schroeder | 250/462.1 |
| 4,122,237 | 10/1978 | Kaiserman | 40/542 |
| 4,543,308 | 9/1985 | Schumann et al. | 250/486.1 |

FOREIGN PATENT DOCUMENTS

| | | | |
|---|---|---|---|
| 1009313 | 5/1952 | France | 40/542 |

*Primary Examiner*—Carolyn E. Fields
*Attorney, Agent, or Firm*—Marcus L. Bates

[57] ABSTRACT

A member, such as a sheet of paper or plastic, is coated with phosphorescence glow on the dark material and then layered or coated with photographic emulsion so that an image can be produced on the surface of the member by a photographic process, and thereafter, an image can be produced on the surface by illumination means. In another form of the invention, a sheet of paper or plastic has luminescent material incorporated therein to cause one side of the sheet of material to glow in the dark. The sheet is assembled onto a clipboard and thereby provides means by which a written message can easily be formed in the dark.

6 Claims, 1 Drawing Sheet

LUMINOUS SHEET AND INDICIA

BACKGROUND OF THE INVENTION

Both young and old enjoy forming shadow images. Usually a dark room is used, with a light being arranged so that a subject located between the light source and a wall surface casts a shadow on the wall. It is fun to trace the outline of the shadow on a piece of paper applied to the wall surface, and thereby provide a permanent image of persons and things.

While this is an entertaining and fascinating pastime, it would be desirable to be able to more rapidly place one's image on a sheet of material attached to the wall, and to be able to instantaneously erase the image. It would also be desirable to be able to utilize such a pastime in conjunction with permanent indicia previously placed on the sheet of material. Apparatus and method which achieves this desirable goal is the subject of the present invention.

Luminescence is the emission of light by various materials, such as glowworms and luminous paints. The term "fluorescence" is sometime accepted as an analogous word. Hence, the term "luminescence" has been accepted for all light phenomena other than incandescence, and it includes a phosphor, an ingredient that emits light for a certain length of time after exposure to an outside energy source. Sufides, including calcium sulfides, are such phosphors. Certain metal oxides, silicates, phosphates, and the sulfides of zinc and cadmium will luminesce if prepared by special procedure.

As used herein, the term "luminous powder" or "luminous material" is intended to include any non-toxic material that glows in the dark after having been subjected to a source of light, so long as the luminous material is compatible with the present invention.

SUMMARY OF THE INVENTION

A sheet of material, made of paper or plastic, has means associated therewith by which it exhibits luminescence. The sheet of material is advantageously used to cover at least part of the wall surface of a room. The sheet of material that exhibits luminescence can be in the form of a framed picture, or it can be permanently applied to the wall in a manner similar to wallpaper. A subject spaced from the wall can have his image temporarily captured on the sheet of material by utilizing a strobe or other illumination means that cast the subject's shadow on the sheet of material.

In another embodiment of the invention, a sheet of material that exhibits luminescence is made onto a clipboard that provides a surface upon which indicia can be placed in the dark.

In another embodiment of the invention, the sheet of material is coated with phosphorescence pigmented coating and then layered with a coating of photographic emulsion material so that a photographic image can be printed onto the paper, and thereafter the sheet of paper can be used to superimpose a shadow onto the photographic image formed on the sheet, or adjacent to the photographic image formed on the sheet, by utilizing a proper light source.

Accordingly, a primary object of the present invention is the provision of a sheet of material having one side which exhibits luminescence and thereby enables an image to be formed on the surface thereof.

Another object of the present invention is the provision of a wall covering which exhibits luminescence and enables the surface to be used for forming images thereon.

A still further object of the present invention is the provision of a sheet of material having a luminescent surface with a picture formed thereon which enables an image to be superimposed upon the picture.

Another and still further object of the present invention is the provision of a sheet of material having a permanent image formed on one surface thereof, and which includes means by which the surface exhibits luminescence so that a shadow formed on the surface provides a transitory image which is superimposed on the permanent image.

A further object of this invention is the provision of a clipboard which enables one to write on a surface thereof in the dark.

Another and still further object of this invention is the provision of a wall board which enables one to write on a surface thereof in the dark.

An additional object of the present invention is the provision of a wall covering for a room which has a surface made of luminescent material, with means forming permanent indicia on said surface, so that a shadow cast on said surface provides a second image of a transitory nature.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
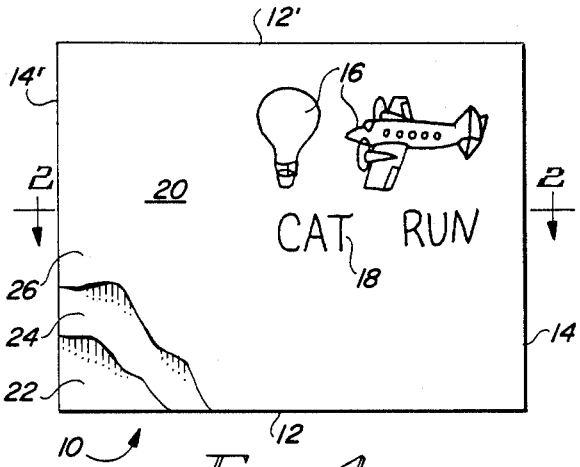
FIG. 1 is a plan view of apparatus made in accordance with the present invention, with some parts being removed therefrom to illustrate the details thereof.

In FIG. 1, there is disclosed a member 10, made in accordance with the present invention, which is in the form of a sheet of material. The member 10 has opposed front and rear surfaces, and opposed edge portions 12, 12' and 14, 14'. Indicia 16 and 18, which can take on any number of different forms, is placed on the front face of the member. A large area 20 remains free of indicia.

The member 10 includes a relatively flexible sheet of paper or plastic 22. The paper or plastic forms a support or substructure and further includes a coating of phosphorescence powder at 24 and a coating of photographic emulsion at the outermost surface 26. Accordingly, images can be photographically applied to the surface 26 while the coating 24 causes the entire surface of the member 10 to glow in the dark under appropriate conditions.

Where the member 10 is a sheet of plastic, phosphorescence powder or pigment is admixed with the plastic during the manufacture of the sheet so that the sheet 22 glows in the dark following illumination thereof. A coating of photographic emulsion material is applied to the substructure and forms the outermost surface of the sheet to thereby enable photographic images 16 and 18 to be reproduced thereon using common photographic processing methods.

Figure 3:
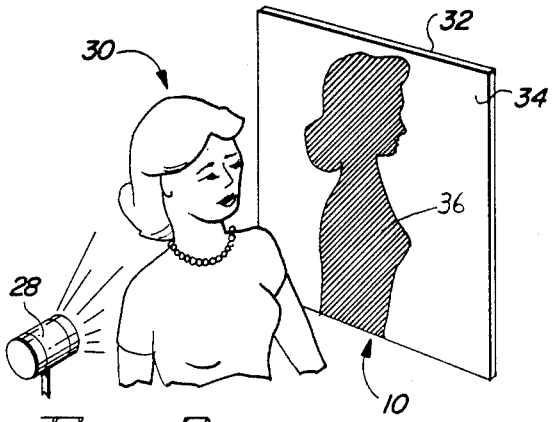
FIG. 3 is a part diagrammatical, part schematical view showing one use of the present invention.

In FIG. 3, a strong source of illumination 28, such as a strobe or strong light, is directed towards the member 10 of the present invention. An object 30, such as a person, is interposed between the light source 28 and the member 10. The shadow image of the object 30 is transferred onto the surface 34 of the sheet of material 32 as indicated by numeral 36.

It is preferred that the illumination means 28 be a strobe because the strobe is very strong and requires only an instant in order to produce an image 36 on the sheet of material 32, or to erase an image 36 from the sheet.

Figure 4:
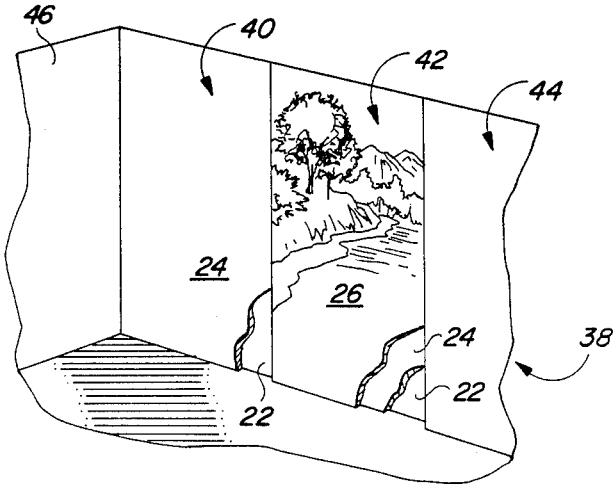
FIG. 4 sets forth another embodiment of the present invention.

In FIG. 4, there is disclosed a room 38, such as a bedroom or study, having wall surfaces covered by different panels 40, 42, 44, and 46. The panels 44–46 are made in accordance with the present invention and therefore glow in the dark following strong illumination.

The panel 40 is comprised of a sheet of paper 22 having a coating of phosphorescence material applied thereto so that the entire surface 24 glows in the dark following illumination.

As another embodiment of the present invention, the panel 44 or 46 is comprised of a sheet of plastic material having phosphorescence material or pigment admixed therewith so that the entire panel glows in the dark following illumination.

In the embodiment seen at 42, a sheet of paper 22 has a coating of phosphoresence material thereon which in turn is covered by a coating of photographic emulsion material 26 so that images can be photographically reproduced thereon and thereafter the image appears on the glowing panel in the dark, following illumination.

In FIG. 4, the wall surfaces 40–46 glows in the dark and provides a pleasant, subdued light. When the lights (not shown in room 38 are turned on and then turned off, there is a pleasant, subdued light provided by the panels for a considerable length of time which provides sufficient illumination to enable one to move about in the room and determine the presence of large objects. The wall covering 40–46 is energy conservative and provides a comfortable, subdued light that is restful and tranquil.

The wall covering 26 of panel 42 provides subdued light along with pleasant indicia which is photographically reproduced in the manner of FIG. 1.

Many different pictures can be reproduced on the surface 26 as may be desired. The pictures may be representative of all sorts of different subject matters including mountain scenes, sailboats, airplanes, and the like.

Figure 5:
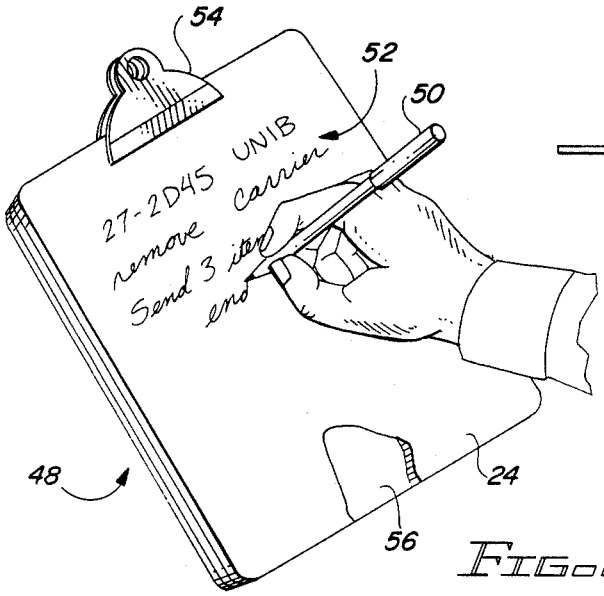
FIG. 5 is a broken, perspective view showing another use of the present invention; and, FIG. 6 is a side view of the apparatus disclosed in FIG. 5.
Figure 6:
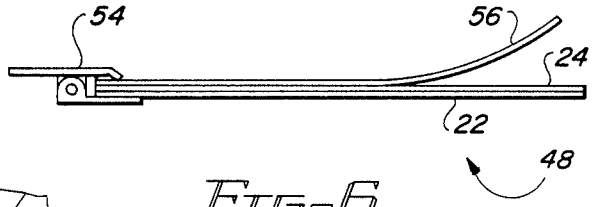

In FIGS. 5 and 6, a sheet of material such as seen at 22, 24 has been made into a clipboard 48. A felt pen, such as a Magic Marker TM 50 can be used for writing on the luminous surface 24. Indicia 52 can be permanently printed on part of the surface 24 and other indicia can be added with the Magic Marker TM. Cover 56 shields the writing surface 24. The apparatus of FIGS. 5 and 6 can be in the form of a notebook or a clipboard.

Figure 2:
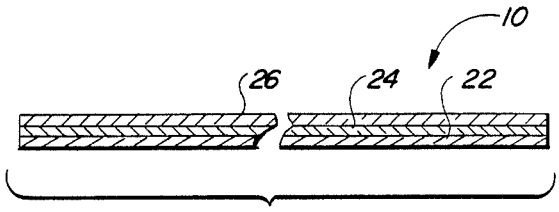
FIG. 2 is a cross-sectional view taken along line 2—2 of FIG. 1.

In the embodiments of FIGS. 1 and 2, paper is coated with phosphorescence glow in the dark pigment and then layered or coated with photographic emulsion so that there are two coatings of material applied to the sheet of paper. The paper can then be photographically printed using an ordinary photographic process. The paper will then glow in the dark when the surface thereof is illuminated momentarily which advantageously shows up the photographic image. Black and white photography techniques are preferred, but color print can also be advantageously used.

The sheet of material can be plastic or paper. The sheet of material with or without the photographic images 16 and 18 enable shadow art to be practiced. A light is spaced from the surface 20 of material 10 and anything placed between the light and the paper provides a shadow image adjacent to or superimposed upon indicia 16 and 18. A strobe can be used to leave a shadow image each time it goes off, thereby providing valuable amusement and educational apparatus. The strobe enables the shadow to be superimposed onto an existing image 16 and 18 or onto a space 20 of the sheet. The strobe is strong and fast. Break dancing, for example, catches a shadow on the wall when the sheet 10 is used as a wall covering as indicated in FIG. 4, or as a framed sheet as seen in FIG. 3.

The clipboard of FIG. 5 is valuable for pilots, policemen, and others who occasionally need to write in the dark. The glowing pad enables legible information to be added to the surface thereof without turning on a light. Secret messages and notes can therefore be assembled without lights. The light, when it is turned on, does not erase the message. The surface can be used over and over again. Both sides of the paper can be used. There can be indicia on one side related to any particular subject matter desired, and the other side can be left blank so that notes can be added thereto.

The wall paper of FIG. 4 enables a large area of a room to be covered and provides a pleasant, subdued light which is energy conservative and provides entertainment.

I claim:

1. A method of providing a glow-in-the-dark image on wallpaper comprising the steps of:

providing a sheet of phosphorescent material suitable for subsequent use as wallpaper that glows in the dark when illuminated and thereafter viewed in the dark;

applying a coating of photosensitive emulsion over one surface of said sheet of phosphorescent material;

providing a glow-in-the-dark image on said one surface of said sheet of phosphorescent material by selecting said image and thereafter imagewise exposing and processing said photosensitive emulsion to produce said image;

wherein said sheet of material can be exposed to light and thereafter said image can be viewed in the dark.

2. The method of claim 1 and further including the step of using a picture of a person as said image, and making said sheet of material by applying a coating of phosphorescent material on a sheet of paper.

3. The method of claim 1 and further including the step of making said sheet of material from a synthetic plastic material having powdered phosphorescent particles of material dispersed therein in an amount to glow in the dark.

4. A method of providing a glow-in-the-dark image on a sheet of material by making a self-supporting sheet of phosphorescent material suitable for subsequent use as wallpaper that glows in the dark when first illuminated and immediately thereafter viewed in the dark, said method comprising:

making said self-supporting sheet of material by applying a coating of photosensitive emulsion over one surface of a sheet of phosphorescent material;

providing said glow-in-the-dark image on said one surface of said sheet of phosphorescent material by selecting said image and thereafter imagewise exposing and processing said photosensitive emulsion to produce said image;

wherein said sheet of phosphorescent material can be exposed to light and immediately thereafter said image can be viewed in the dark.

5. The method of claim 4 and further including the step of using a picture of a person as said image, and making said sheet of phosphorescent material by applying a coating of phosphorescent material on a sheet of paper.

6. The method of claim 5 and further including the step of making said sheet of phosphorescent material from a synthetic plastic material having powdered phosphorescent particles of material dispersed therein in an amount to glow in the dark.

* * * * *